US005343686A

United States Patent [19]

Büchner et al.

[11] Patent Number: 5,343,686

[45] Date of Patent: Sep. 6, 1994

[54] PROCESS AND DEVICE FOR PNEUMATIC INTRODUCTION OF FIBERS INTO A SPINNING MACHINE

[75] Inventors: Thorsten Büchner; Michael Ueding, both of Ingolstadt, Fed. Rep. of Germany

[73] Assignee: Rieter Ingolstadt Spinnereimaschinenbau AG, Ingolstadt, Fed. Rep. of Germany

[21] Appl. No.: 926,003

[22] Filed: Aug. 5, 1992

[30] Foreign Application Priority Data

Aug. 10, 1991 [DE] Fed. Rep. of Germany ..... 4126552
Sep. 13, 1991 [DE] Fed. Rep. of Germany ..... 4130510

[51] Int. Cl.[5] ..... D01H 15/02; D01H 1/40

[52] U.S. Cl. ..... 57/263; 19/159 A; 57/279; 57/281; 57/352; 57/405; 57/417

[58] Field of Search ..... 57/261, 263, 279, 405, 57/417, 352, 281; 19/159 A, 157, 0.26

[56] References Cited

U.S. PATENT DOCUMENTS 3,962,855 6/1976 Stahlecker ..... 57/417 X
4,055,942 11/1977 Stanlecker ..... 57/263
4,379,386 4/1983 Goldhammer et al. ..... 57/405
4,570,430 2/1986 Stahlecker ..... 57/263
4,757,678 7/1988 Stahlecker ..... 57/405 X
4,763,387 8/1988 Bothner ..... 19/157 X
4,932,201 6/1990 Meroni et al. ..... 57/281 X
4,939,895 7/1990 Raasch et al. ..... 57/281 X

FOREIGN PATENT DOCUMENTS 0348678 1/1990 European Pat. Off. .

*Primary Examiner*—Daniel P. Stodola
*Assistant Examiner*—William Stryjewski
*Attorney, Agent, or Firm*—Dority & Manning

[57] ABSTRACT

A process for introducing a fiber sliver into a fiber processing machine which has an openable sliver feeding device and a sliver introduction funnel and a sliver injector, comprising the following steps: opening the openable sliver feeding device, grasping the leading end of the sliver pneumatically into and through the sliver introduction funnel and into the opened feeding device and closing the sliver feeding device on the sliver. The invention also includes a device for carrying out the process.

31 Claims, 7 Drawing Sheets

PROCESS AND DEVICE FOR PNEUMATIC INTRODUCTION OF FIBERS INTO A SPINNING MACHINE

BACKGROUND OF THE INVENTION

The instant invention relates to a process and to a device for the pneumatic introduction of a fiber sliver into a spinning machine.

A device and a process are known from EP 0 348 678 A1 in which the fiber sliver is introduced pneumatically. The device shown therein is provided with a compressor. This compressor is installed in a fixed position at a spinning station and is subjected in such manner to an air stream emitted by an injection nozzle coupled upstream when a fiber sliver has been presented to it at a tubular fiber sliver suction opening that the fiber sliver is conveyed or flows in the direction of the narrowest part of the compressor.

A disadvantage of this known device is that a relatively weak suction force acts upon the fiber sliver in the tubular suction opening because of the cross-section required. On the other hand, there is a danger at the narrowest part of the compressor that it will be clogged up by the fiber sliver due to the air pressure acting upon the fiber sliver so that it is not always certain that the fiber sliver will emerge from the compressor far enough so that it can be grasped at that location and conveyed further by additional devices.

OBJECTS AND SUMMARY OF THE INVENTION

It is a principle object of the instant invention to overcome the above-described disadvantages and to create a process and a device which makes it possible to achieve the simple and safe feeding of a fiber sliver into a spinning machine.

BRIEF DESCRIPTION OF THE DRAWINGS

To clarify the nature of the invention, embodiments of the invention are described below through drawings and descriptions.

DETAILED DESCRIPTION OF THE PREFERRED EMBODIMENTS

Figure 1:
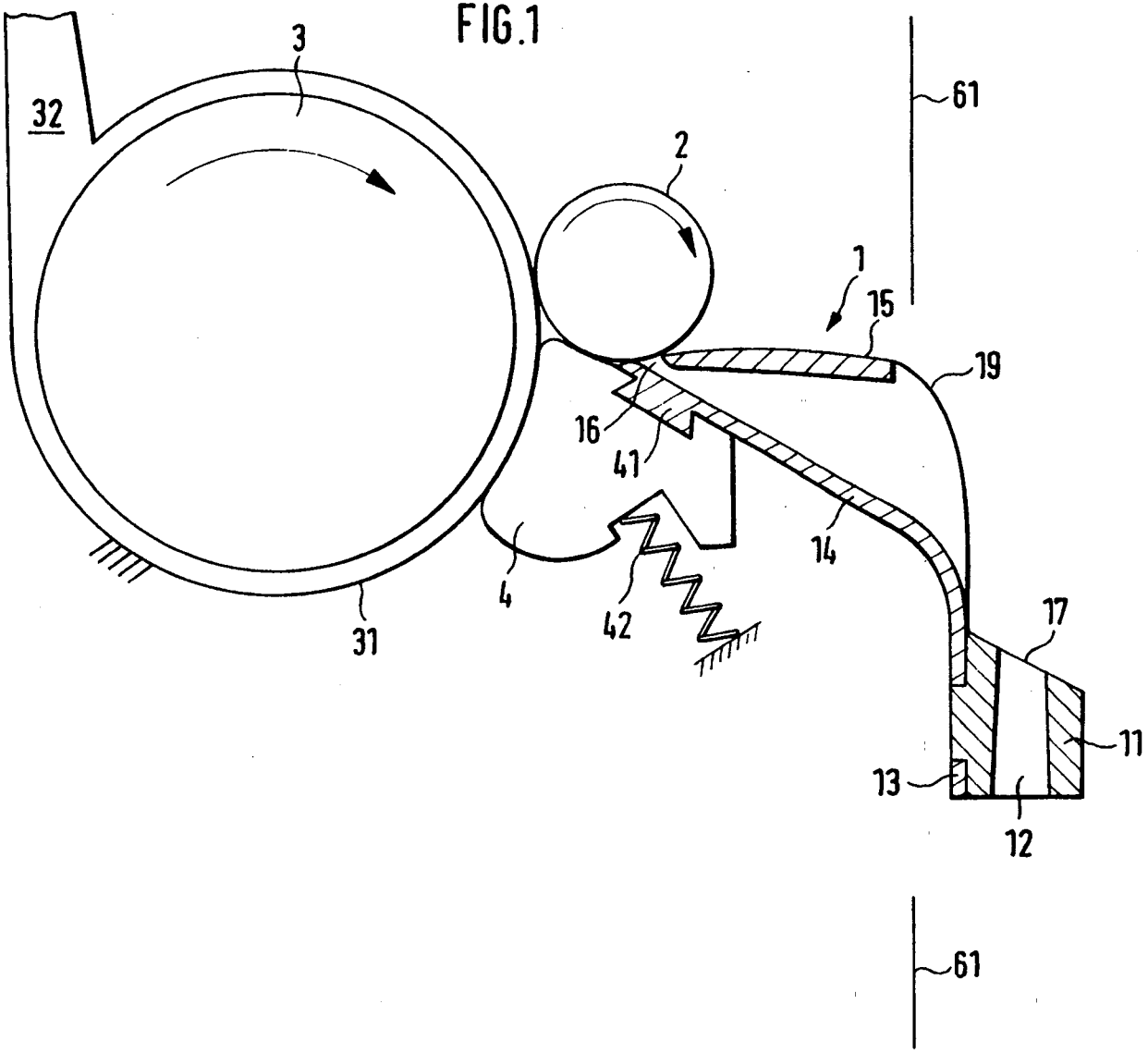
FIG. 1 is a schematic side view of a spinning station, in section, before the opening of the nip point of the feeding device.

FIG. 1 is a sectional view of an open-end spinning machine with an introduction funnel 1, a feed roller 2, a feed tray 4 and an opener roller 3 linked to the feed tray and the feed roller, which is located in a opener roller housing 31. The opener roller housing 31 is followed by a fiber feed channel 32 which serves to convey the opened fibers to a spinning element (not shown), e.g. a rotor or a friction spinning device. Since this is a sufficiently well known open-end spinning device, no detailed description is given here. The introduction funnel 1 is connected by means of a clip or dovetail joint to the feed tray 4 which can be moved concentrically around the axis of the opener roller. This connection is designed so that it can be opened. The feed tray 4 is pressed by a spring 42 with one side against the outer wall of a opener roller housing 31 and with the other side against the feed roller 2.

The introduction funnel 1 projects out of the spinning device with its connected loop catcher 11, the boundary of the spinning device being represented by line 61. This boundary line 61 marks, at the same time, the outer edge of the open-end spinning machine. The fiber sliver 9 (FIG. 2) is guided through a channel 12 of the loop catcher 11 and is then guided to the introduction funnel 1. The introduction funnel 1 serves mainly to separate adhering second loops from fiber sliver 9 being taken out of a fiber sliver can so that only the correct fiber sliver profile may enter the spinning station. Normally the profile of channel 12 is round-oval in form. The loop catcher 11 itself can be made so that it may be removed from the introduction funnel 1 and is advantageously clipped to the leg part 13 of the introduction funnel 1 by means of a clip. The introduction funnel 1 has two sides 14 and 15 converging in the direction of the nip of the feed device, their point of greatest convergence being at a narrowing 16, which is closest to the nip line of the clamping elements 2 and 4. The spring 42, which presses the feed tray 4 against the feed roller 2 and the opener roller housing 31, bears upon the inside of the housing of the spinning station. In this embodiment only one spring 42 is shown. But it is, of course, also possible to provide several springs with different points of attack. It is also possible to move the feed roller around a point of rotation which is not located within the rotational axis of the opener roller.

Figure 2:
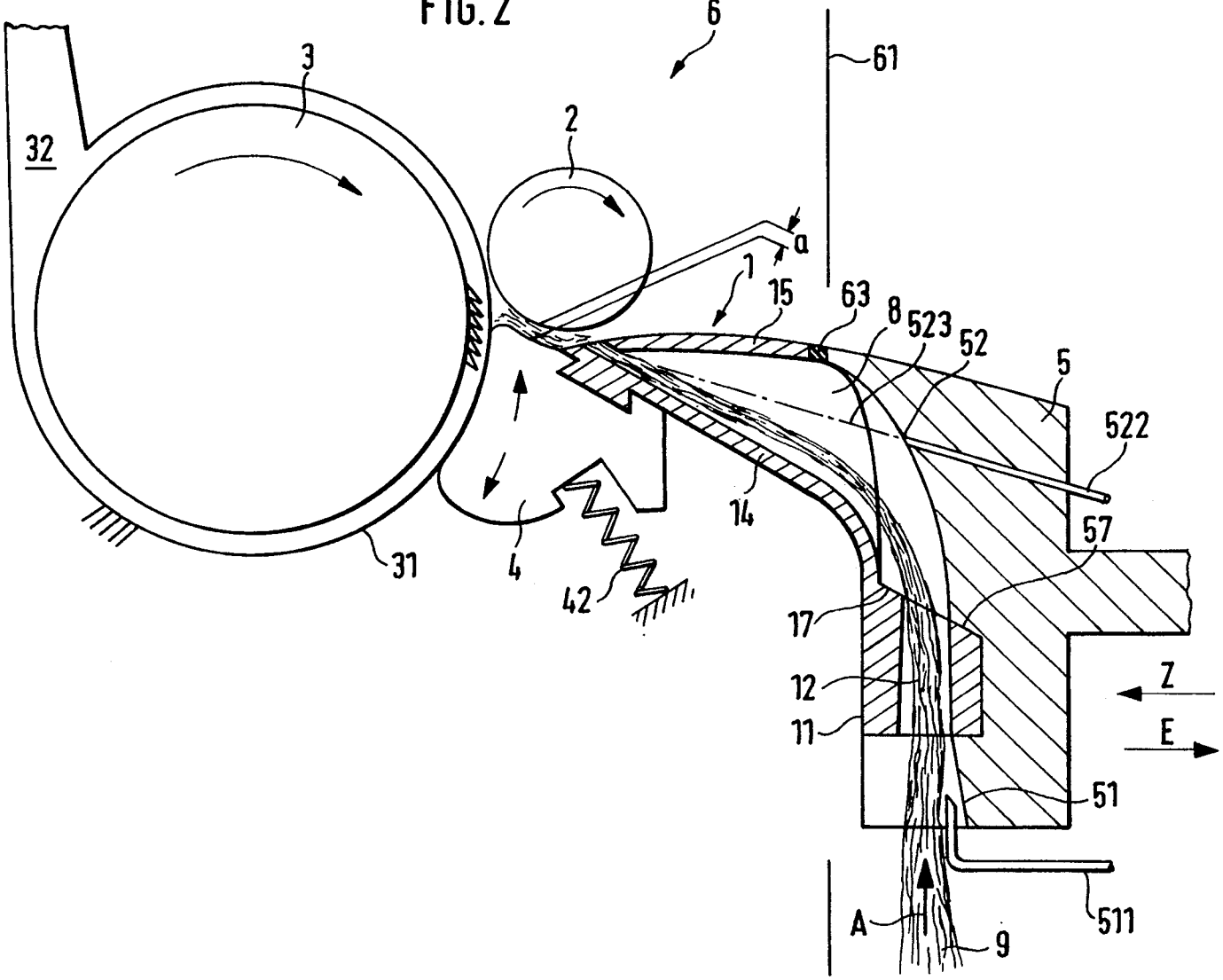
FIG. 2 is a schematic side view of the spinning device, in cross-section, after the application of an injector to the feeding device.

FIG. 2 essentially shows the device described in FIG. 1, but an injector 5 provided with a compressor at the interface surface with the introduction funnel 1 is mounted on the introduction funnel 1 and has been moved in such manner that the introduction funnel 1 and the connected feed tray 4 have moved away from the feed roller 2 so that the nip between these two clamping elements is open. Injector 5 was moved into this position by a movement in the direction of arrow Z and was pressed against the introduction funnel 1. A run-up surface 57 presses against a run-up surface 17 of the introduction funnel 1 as a result of the movement of injector 5 in direction of arrow Z and causes the feed tray 4 to be pressed downward and the nip is thus opened. The injector 5 is supported in such articulated manner that it is able to follow a small rotational movement of the feed tray 4 without leaks being produced between the introduction funnel 1 and the injector 5. If the injector 5 is moved away from the spinning station in the direction of arrow E after the introduction of the fiber sliver 9, feed tray 4 and the connected introduction funnel 1 move up under the spring effect of spring 42. The feed tray 4 then presses the fiber sliver against the fixed attached feed roller 2.

To carry out the process for the conveying a fiber sliver 9 on a spinning station, the following procedure is followed: The injector 5 is brought to the spinning station by means of a device not shown here, e.g. floor vehicle travelling alongside the open-end spinning machine, an automatic service unit installed on the spinning machine or some other service vehicle, and is moved against the introduction funnel 1 in such manner that the feed tray 4 moves away from the feed roller 2. At the same time, the injector 5 is positioned on the introduction funnel 1 by means of conventional positioning methods such as are customarily used with automatic service units at spinning stations. The beginning of the fiber sliver 9 is then presented (by a device which is not shown here) to the injector 5 in the direction of arrow A at its introduction opening. Under the suction effect of an air stream directed via a circuit 522 from a source of compressed air via a nozzle 52 into a fiber sliver channel 8, the fiber sliver 9 is conveyed into the fiber sliver channel 8 and on in the direction of an action line 523 of the air stream flowing out of the nozzle 52. The fiber sliver channel 8 is constituted through the fact that the two device elements, introduction funnel 1 and injector 5, are sealed tightly together. Fiber sliver 9 goes through the narrowest point 16, between the feed roller 2 and the feed tray 4, so that the leading end of the fiber sliver is presented to the opener roller 3 for processing. A nozzle 51 may be mounted in the lower part of injector 5. It is actuated to assist the injection process, preferably with a slight time advance, in such manner that an essentially vertical suction flow is injected into channel 8 so that the fiber sliver 9 is moved up. The additional action of nozzle 52, already described earlier, will then take over the directional deflection and additional conveying of fiber sliver 9. Nozzle 52 is positioned so that it emits a flow which acts in channel 12 of the loop catcher 11 in such manner that a slight eddy flow is created at that point, twisting together the beginning of the fiber sliver 9 in the manner in which one twists together the end of a yarn with one's fingers so as to make it more pointed and to thread it through a narrow passage. If the fiber sliver 9 has now been conveyed up to the nip just before the opener roller 3, a service unit (not shown, and which could also be represented by an operator) moves the injector 5 away from the introduction funnel 1 or the spinning unit 6, i.e. preferably in the direction of arrow E. Due to the fact that the injector is open on its underside in the area of nozzle 52, pointing to the spinning machine, it can be moved away unhindered from the spinning station without impeding the fiber sliver 9. This opening at the leg of the injector can be seen in FIG. 5, reference 58*a*.

Figure 3:
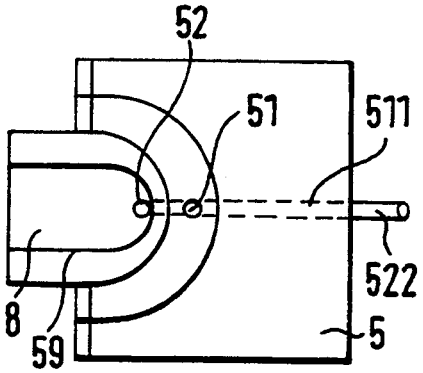
FIGS. 3 and 4 are top views of injectors with different arrangements of compressed-air nozzles.
Figure 4:
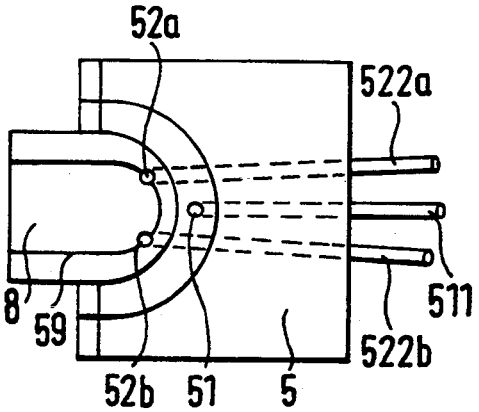

In a top view of injector 5, FIG. 3 shows a line 59 forming the inner wall of the "channel half" of channel 8 which is formed by putting together the elements injector and introduction funnel. The symmetric arrangement of the nozzle channel 522 and the nozzle 52 can also be recognized in FIG. 3. By contrast thereto, FIG. 4 shows nozzle channels 522*a* and 522*b* or their nozzles 52*a* and 52*b*, whereby the nozzle channels 522*a* and 522*b* are oriented so that their action lines intersect at the narrowest point 16 of the introduction funnel 1. In addition the layout of a nozzle channel 511 and of nozzle 51 can be recognized here.

Figure 5:
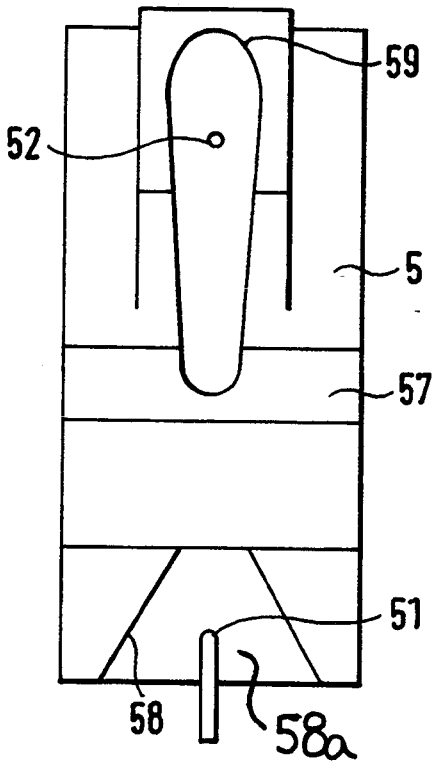
FIG. 5 is a front view of the injector, looking into the injector opening.

FIG. 5 shows a front view of the injector 5, in the lower part of which it can readily be seen that a fiber sliver introduction opening 55 (FIG. 7) is designed so that it extends upward in essentially a conical configuration so that its cross-section at the point of transition into the loop catcher 11 of the introduction funnel 1 is approximately as large as the cross-section of channel 12 of the loop catcher. When the injector 5 is properly installed on the introduction funnel 1 or on its loop catcher 11, a side 58 will be continued by the side of channel 12 of the loop catcher 11 and in the further course of channel 8 by a side 59 of injector 5. The points of transition of the channel parts introduction opening 55 of injector 5, channel 12 and channel side 59 should be made as free of edges and as smooth as possible so that when the fiber sliver 9 it may not be damaged and individual device parts do not become clogged.

Figure 6:
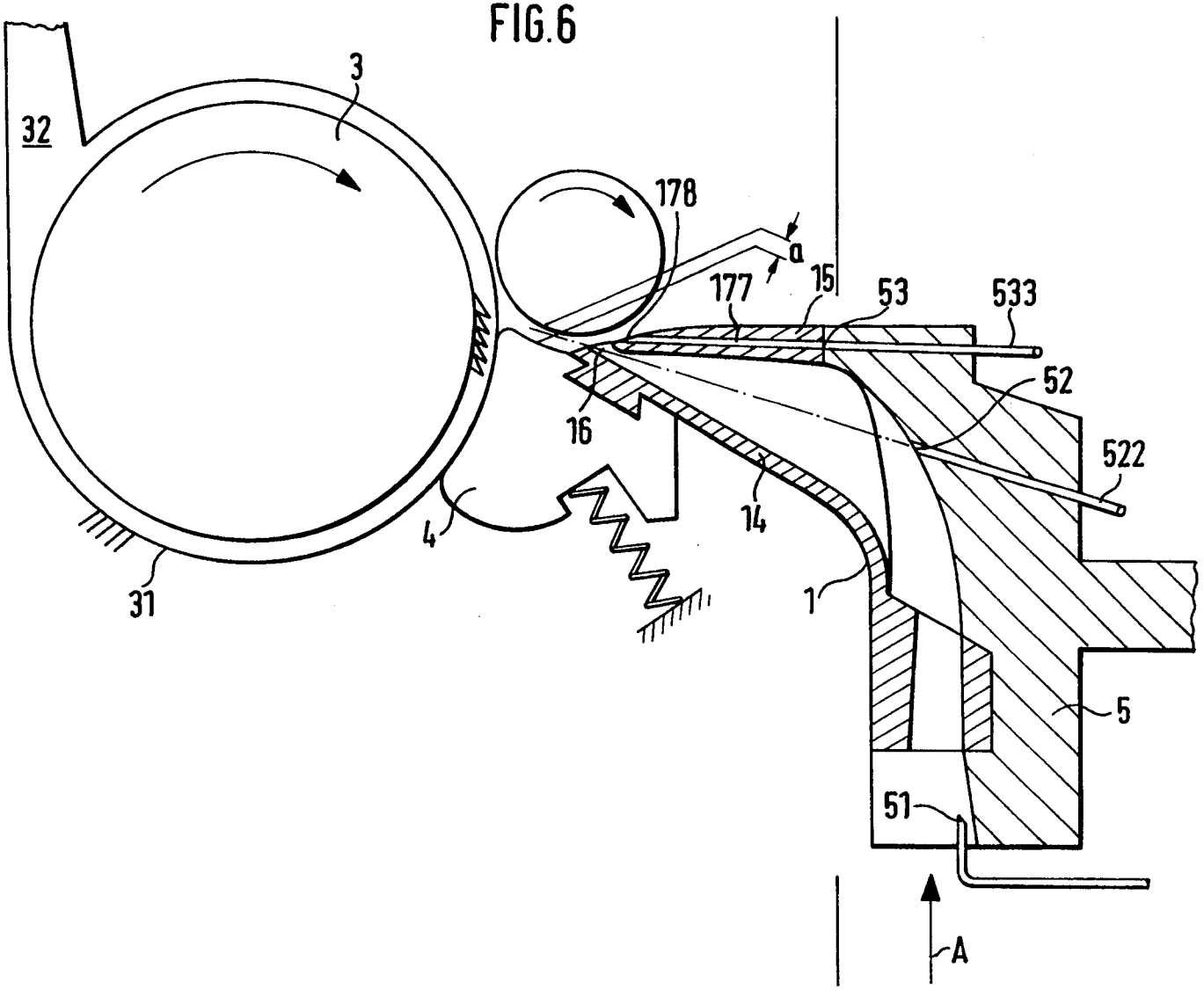
FIG. 6 is a schematic side view of an additional embodiment of the introduction funnel in a section.

FIG. 6 shows another embodiment of the invention. Here, an injector 5 with an additional nozzle 53 is provided, with nozzle 53 not letting out directly into the fiber sliver channel 8 as do the other two nozzles 52 and 51, but into a nozzle channel 177 which is located in the upper side 15 of the introduction funnel 1 and lets out with a nozzle 178 located just before the nip between feed roller 2 and feed tray 4. This third nozzle 53 can be useful when fiber material that cannot be easily introduced into the introduction funnel 1 because of its weight or its friction characteristics is processed. In such a case, the air stream conveying fiber sliver 9 is assisted in the direction of the nip of the spinning device due to the fact that a negative pressure is produced at the narrowest point 16 by means of the air flowing through nozzle 178, causing fiber sliver 9 or the beginning of fiber sliver 9 to move more easily through the narrowest point 16 towards the nip or between the nipping elements of the spinning device. In a similar manner, it is possible to have an additional nozzle installed in side 14 which can be appropriately subjected by injector 5 with compressed air.

In an advantageous manner the feeding of the fiber sliver 9 can also be assisted in that fiber sliver 9 is lifted up so far by a device that the device according to the invention must only lift the fiber sliver length which is introduced into the spinning station.

The above-described process and the different devices for carrying it out can, of course, be applied to all open-end spinning devices and are not limited to rotor spinning. The feed device, for example, can be made in form of a leather tape drafting system. The spinning device can also be a friction or air spinning device or simply a spinning device in general, working with open end or opened fibers.

This fiber feeding can also be provided for other fiber-processing machines such as draw frames, for example, where it is useful to provide a feed system which is itself capable of conveying the fiber sliver on for further processing once the presenting device has presented the fiber sliver to the feed device.

The conveying device for nozzles 51, 52 and 53 or other nozzles that are provided, are supplied with compressed air through the shown circuits. The control of the injector nozzle flowing time can be adjusted individually, depending on the fiber sliver. A suitable control is one which makes it possible to control the nozzles and their switching sequences according to the operator's free choice.

The device according to invention is also suitably integrated in electronically controlled automatic service units which verify the presence of another fiber sliver before the introduction of a fiber sliver into a spinning station. It is possible that a spinning can containing the fiber sliver supply is already present at a spinning station, whereby the fiber sliver end to be introduced hangs out of the can in a defined position, or has already been presented by means of a known device at a predetermined position at the spinning station. Furthermore, a service vehicle can remove an empty spinning can from the respective spinning station, bring a can containing a fiber sliver to the spinning station, and then feed this fiber sliver by means of the device according to invention to the spinning device.

Injector 5 or the (not shown) control device of the nozzles of injector 5 are suitably adjusted so that the injection process lasts for approximately 1 second. This is advantageous for the fiber sliver because then no excessively long currents act upon the fiber sliver, altering it or damaging it to such an extent that it can no longer be conveyed without error by the feed device.

The nozzle 178 shown in FIG. 6 can, of course, also be used in interaction with nozzle 53 of injector 5 to clean a possibly clogged nip by means of a short burst of air before the fiber sliver 9 is presented for introduction to the introduction opening 55.

It is also possible to organize the movement of the introduction funnel and the injector so that these take place around a rotational axis which is essentially perpendicular to the longitudinal axis of the open-end spinning machine. The device according to the invention is not limited to the examples shown.

To present the fiber sliver 9 at the leg of injector 5 in order to inject it into the spinning station in the direction of arrow A, it has been shown to be advantageous to use a grasper with two grasping elements of which at least one is movable in such manner that the grasper can be opened and then closed again to grasp the fiber sliver. In a further embodiment of the invention the two graspers are in form of rollers which rotate to assist the introduction process so that the fiber sliver is conveyed in direction of the spinning station. The conveying speed and the moment when the rollers run are suitably coordinated with the control controlling the nozzles.

Figure 7:
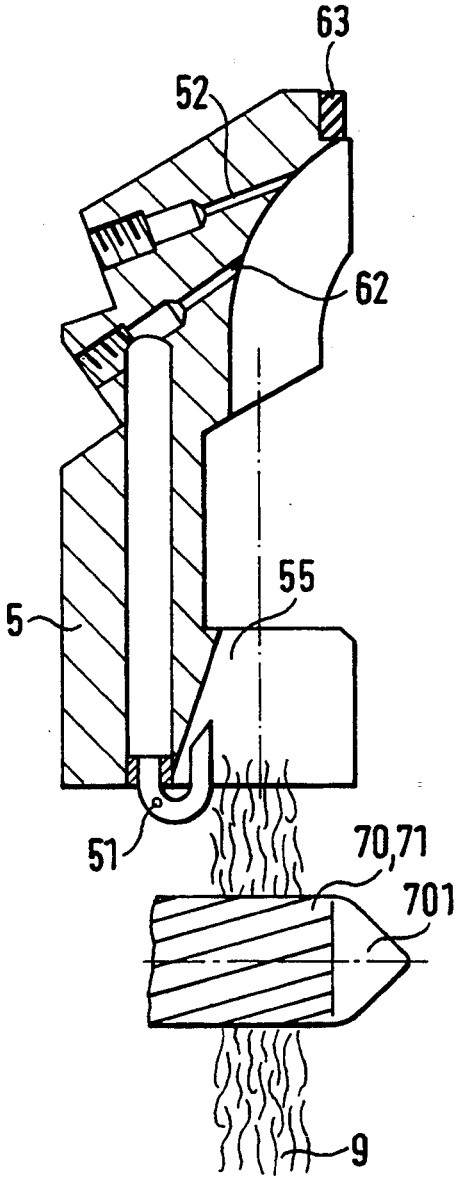
FIG. 7 is a sectional view through an injector of the invention.

FIG. 7 shows injector 5 in a longitudinal section. In this section the positions of the nozzles 51 and 52 as well as of a nozzle 62 are shown. Nozzle 51 is directed against the side wall of the fiber sliver introduction opening 55 in such manner that an air eddy is produced to twist fiber sliver 9 together and/or to make it pointed. This makes a simple threading into the loop catcher 11 of introduction funnel 1 possible. Nozzle 51 is connected to nozzle 62 in this embodiment. Nozzle 62 assists the threading of fiber sliver 9 into the introduction funnel 1 through its suction effect which reaches into the fiber introduction opening 55. Nozzle 52 can be triggered independently thereof and compressed air can be applied to it after nozzles 51 and 62. Thereby an optimal deflection of the fiber sliver 9 in the direction of the narrowest point 16 of the introduction funnel 1 is achieved.

In the direction of fiber sliver movement, directly before injector 5, rollers 70, 71 are installed to serve as additional mechanical sliver conveying devices. Rollers 70, 71 seize the fiber sliver 9 and convey it by means of a rotational movement in the direction of injector 5. Grasping of the fiber sliver 9 is facilitated by conical ends 701 of rollers 70, 71. The fiber sliver 9 thus threads itself automatically into the furrowed rollers 70, 71 when it comes into contact with the conical ends 701 of the rotating rollers 70, 71.

The rotational speed of rollers 70, 71 is preferably such that it brakes the movement of fiber sliver 9 slightly by comparison with the conveying effect of nozzles 51, 52, 62. As a result the fiber sliver 9 is always conveyed under tension through the loop catcher 12 or the narrowest point 16 of the introduction funnel 1. Clogging by the fiber sliver 9 of the channels 11, 16 through which it passes and resulting interference with secure threading into the feed device is thus avoided. Furthermore rollers 70, 71 ensure that a defined quantity and thereby also a defined weight of fiber sliver 9 is conveyed at all times. An adjustment of the flow duration and intensity of nozzles 51, 52, 62 is thus facilitated. Secure conveying of the fiber sliver through channels 11, 16 is thus ensured.

A packing seal 63 is provided at the upper edge of the injector 5. This seal 63 ensures a tight connection between injector 5 and introduction funnel 1. Flow losses in channels 8, 11 are thus avoided.

Figure 8:
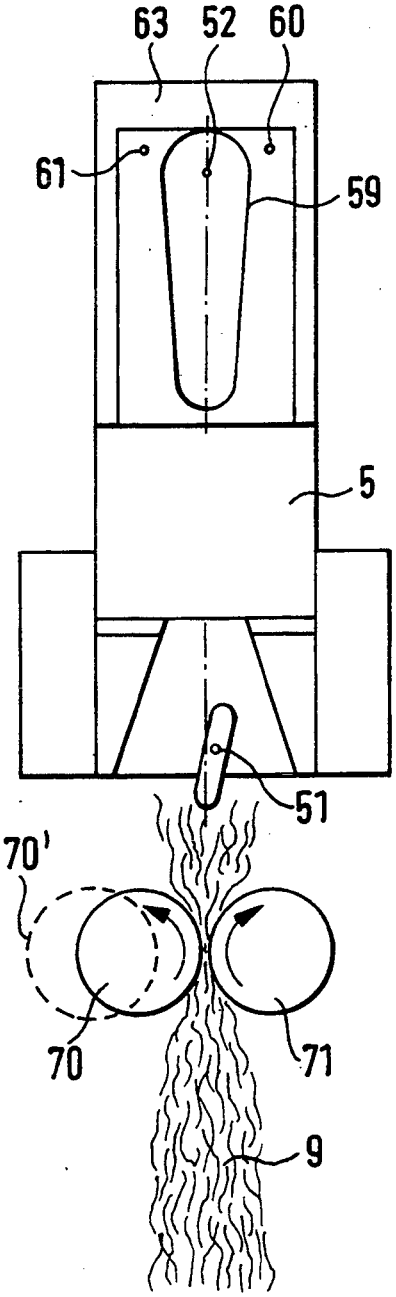
FIG. 8 is a front view the front of an injector.

FIG. 8 shows a front view of injector 5 with the rollers 70, 71. Nozzle 51 is angled towards the center line of injector 5 so that it produces an air eddy which prepares the fiber sliver for introduction into the narrowings. By means of its air stream, nozzle 51, in addition, causes the fiber sliver to be conveyed in direction of nozzle 52. Nozzle 52 causes fiber sliver 9 to be deflected in direction of narrowest point 16 of introduction funnel 1. The fiber sliver 9 is guided at this deflection point through the side 59 of injector 5. To bridge the difference in cross-section between side 59 and the introduction funnel 1, nozzles 60, 61 are provided at the front of injector 5. Nozzles 60, 61 are also directed towards the narrowest point 16 of introduction funnel 1 and cause the fiber sliver to be blown under tension towards narrowest point 16. The additional use of nozzles 60, 61 ensures maintenance of flow velocity in spite of the changed cross-section, without the occurrence of eddies or substantial flow velocity losses. As a result it is possible for the fiber sliver to be conveyed in the direction of narrowest point 16 without production of eddies or loops. Clogging of the narrowest point 16 by the fiber sliver is thus prevented. Nozzles 60, 61 ensure secure conveying of fiber sliver 9 up to the feed device.

The rollers 70, 71 rotate in the direction of injector 5. In this manner the conveying of fiber sliver 9 by air nozzles 51, 52, 60, 61 is assisted mechanically. Depending on the relationship between the fiber sliver dimensions and the passage profiles it is advantageous, especially with a narrow passage profile and a thick fiber sliver, for the rollers 70, 71 to be driven at a speed that will hold the fiber sliver 9 under tension at all times during the pneumatic conveying. This means that the rollers 70, 71 convey more slowly than the air nozzles 51, 52, 60, 61 would. In this manner clogging of the narrowings by fiber sliver 9 is avoided.

The rollers 70, 71, just as the injector 5, are installed on a service unit. Rollers 70, 71 and injector 5 are thus presented only to the spinning machine or spinning station when a fiber sliver is to be conveyed through the narrowings and is to be threaded into the spinning machine. The service unit may be installed directly on the spinning machine and be capable of travelling along a plurality of spinning stations, or may be installed independently of the individual spinning machine on a non-travelling conveying system serving several spinning machines. It has proven to be advantageous for injector 5 and rollers 70, 71 to be placed on a can conveyor and to thereby introduce the new fiber sliver 9 into the spinning station when a can replacement becomes necessary.

In an advantageous embodiment of the arrangement of roller 70, 71 it is possible to move rollers 70, 71 apart (70') and again together in order to grasp the fiber sliver 9. Secure and defined grasping of the fiber sliver 9 is thus ensured.

Figure 9:
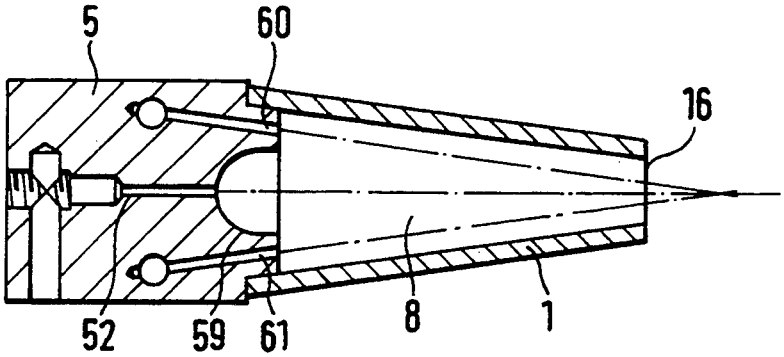
FIG. 9 is a cross-sectional view through an injector and an introduction funnel.

FIG. 9 is a section view through the top of injector 5 and introduction funnel 1. In this drawing the widening of the cross-section at the passage between injector 5 and introduction funnel 1 can clearly be recognized. Fiber sliver 9, which is deflected along side 59 from injector 5 into the introduction funnel 1, would be severely swirled when entering introduction funnel 1 without assistance from nozzles 60, 61, and would thereby risk clogging the narrowest point 16 of introduction funnel 1. Nozzles 60, 61, on the other hand, increase the flow speed in the larger cross-section of the introduction funnel 1 and thus causes the fiber sliver 9 to be put under tension. Furthermore, they prevent excessive friction of the fiber sliver against the sides of the introduction funnel 1. This, too, ensures reliable passage of fiber sliver 9 through the narrowest point 16 of the introduction funnel 1.

It has been proven to be an advantage to first produce an air stream by means of nozzles 60, 61 until fiber sliver 9 is within their effective range, and only then to apply compressed air to nozzle 52 so that fiber sliver 9 is blown through the narrowest point 16.

Nozzles 60, 61 can be omitted if the increase of the cross-section between injector 5 and introduction funnel 1 is not very great. This can be achieved with an introduction funnel 1 by attaching lateral elements to injector 5 which are introduced into channel 8 and thus reduce the cross-section. It is also possible to design injector 5 with its side 59 or even funnel 1 in such manner that no great changes in cross-section occur.

Figure 10:
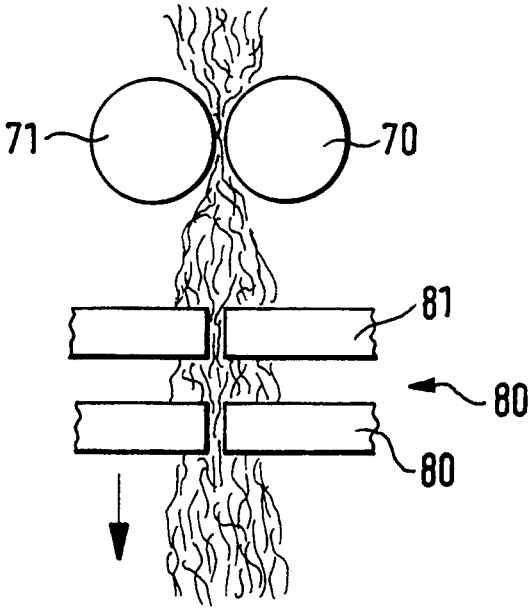
FIG. 10 is a view of a fiber sliver cutting device.

FIG. 10 show a fiber sliver severing device 80. For this purpose a clamp 81 grasps fiber sliver 9 on the side of rollers 70, 71 towards injector 5 and holds said fiber sliver 9 in place. A clamping device 82 also grasps the fiber sliver 9 and following the clamping action moves in the direction of the arrow, away from clamping device 81. In this way fiber sliver 9 is severed between clamping devices 81 and 82. Following this the clamping device 81 releases fiber sliver 9. A defined length of fiber sliver 9 is thus obtained from rollers 70, 71 to the beginning of the fiber sliver 9. This defined length ensures secure introduction of the fiber sliver into injector 5 or introduction funnel 1.

Figure 11:
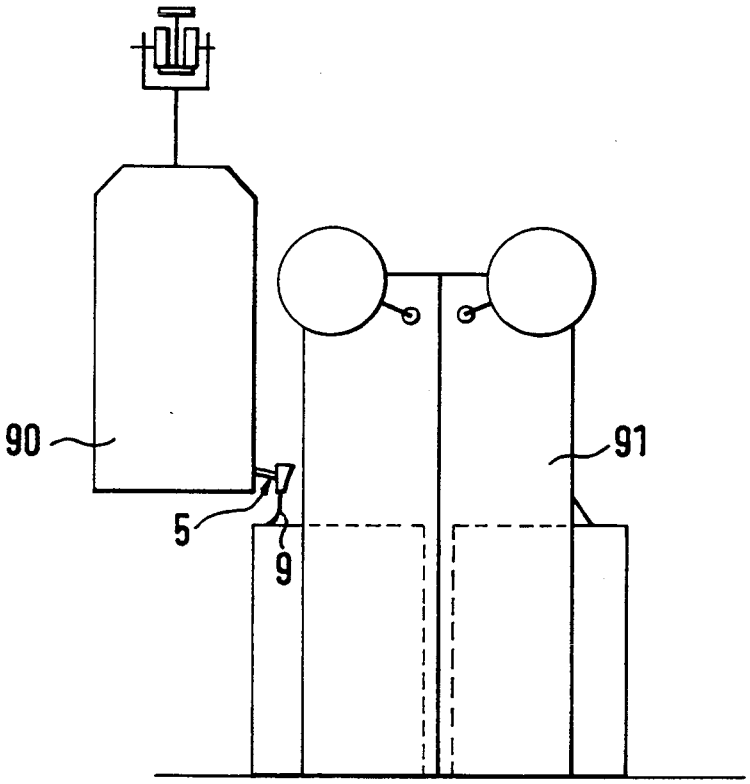
FIG. 11 is a front view of a service unit on a spinning machine.

FIG. 11 shows an automatic service unit 90 at a spinning machine 91. The automatic service unit 90 travel on a rail along spinning machine 91. If a fiber sliver 9 is to be introduced into the spinning station the travelling automatic unit 90 stops at that spinning station. The fiber sliver 9 is grasped and conveyed to the injector 5 which is installed on the travelling automatic unit 90. Fiber sliver 9 is then introduced into the nip of the spinning station.

This invention is not limited to the embodiments described. It will be apparent to those skilled in the art that various modifications and variations can be made in the apparatus and method of the present invention without departing from the scope or spirit of the invention. Thus it is intended that the present invention cover the modifications and variations of this invention provided they come within the scope of the appended claims and their equivalents.

We claim:

1. A process for introducing a fiber sliver into a fiber processing machine which has an openable sliver feeding device and a sliver introduction funnel, comprising the following steps:

(a) locating a travelling sliver injector device in front of said fiber processing machine;

(b) opening said openable sliver feeding device with said sliver injector device;

(c) configuring said sliver injector device into contact with said sliver introduction funnel so as to define a sliver feeding channel therewith;

(d) grasping a leading end of said sliver and conveying the sliver end into the sliver injector;

(e) pneumatically conveying said leading end of said sliver into and through said sliver feeding channel and said sliver introduction funnel and into said opened feeding device; and (f) closing said sliver feeding device on said sliver.

2. A process for introducing a fiber sliver as set forth in claim 1, including moving said injector to said fiber processing machine before grasping said leading end of said sliver and away from said fiber processing machine after said fiber sliver is introduced into said feeding device.

3. A process for introducing a fiber sliver as set forth in claim 1, including pneumatically shaping said leading end of said sliver before introducing it into said funnel.

4. A process for introducing a fiber sliver as set forth in claim 1, including mechanically feeding said sliver to said sliver injector during said pneumatic conveying of said sliver leading end.

5. A process for introducing a fiber sliver as set forth in claim 4, wherein said mechanically feeding is at a predetermined velocity.

6. A process for introducing a fiber sliver as set forth in claim 5, wherein said pneumatic conveying of said leading end of said sliver is at a predetermined velocity which is greater than said predetermined velocity of said mechanically feeding so as to convey said sliver under tension.

7. A process for introducing a fiber sliver as set forth in claim 1, wherein said step of pneumatically conveying said sliver comprises conveying said sliver end with two streams of compressed air which are applied at different times.

8. A process of introducing a fiber sliver as set forth in claim 7, including applying one of said streams of compressed air closer to said fiber processing machine than the other.

9. A process for introducing a fiber sliver as set forth in claim 8, including applying the compressed air stream farthest from said fiber processing machine first.

10. A process for introducing a fiber sliver as set forth in claim 7, including applying a third stream of compressed air on said sliver in the direction of a nip line of said feeding device.

11. A device for introducing a fiber sliver to a fiber processing machine which has an openable sliver feeding device and a sliver introduction funnel, comprising:

(a) a sliver injector adapted to pneumatically introduce a sliver into said funnel, said injector disposed to contact said funnel and to form a pneumatic sliver feeding chamber with said funnel;

(b) compressed air means disposed in said injector for directing a stream of compressed air into said pneumatic chamber in a direction to convey said sliver into said feeding device; and (c) said injector defining a control device configured to open said feeding device prior to directing said stream of compressed air into said pneumatic chamber said air of compressed air stream being directed into said pneumatic chamber to convey the leading end of said sliver into said feeding device.

12. A device for introducing a fiber sliver as set forth in claim 11, wherein said feeding device comprises a roller mounted for rotation about a fixed axis and a feeding tray which is biased towards said roller.

13. A device for introducing a fiber sliver as set forth in claim 12, wherein said compressed air means comprises a nozzle disposed in said injector to direct a stream of compressed air into space between said tray and said roller.

14. A device for introducing a fiber sliver as set forth in claim 12, wherein said compressed air means comprises two nozzles disposed in said injector for directing two streams of compressed air in intersecting paths in the space between said tray and said feed roller.

15. A device for introducing a fiber sliver as set forth in claim 11, wherein said processing machine further comprises a loop catcher disposed upstream of said sliver introduction funnel.

16. A device for introducing a fiber sliver as set forth in claim 11, wherein said injector has a packing seal on its surface in contact with said introduction funnel.

17. A device for introducing a fiber sliver as set forth in claim 11, wherein said feeding device comprises an enlargeable passage opening to receive a sliver.

18. A device for introducing a fiber sliver as set forth in claim 11, wherein said compressed air means comprises a nozzle directed upon a guiding surface to cause said air stream to form eddy currents to twist the leading end of said sliver.

19. A device for introducing a fiber sliver as set forth in claim 11, wherein said sliver introduction funnel comprises a feeding channel which converges towards said feeding device and said compressed air means comprises a plurality of nozzles directed at the converging end of said channel to exert tension on said sliver passing through said channel.

20. A device for introducing a fiber sliver as set forth in claim 11, further comprising a mechanical sliver conveying device for conveying said sliver before it enters said injector.

21. A device for introducing a fiber sliver as set forth in claim 20, wherein said mechanical sliver conveying device comprises a pair of driven rollers.

22. A device for introducing a fiber sliver as set forth in claim 21, wherein said driven rollers are driven at a speed which insures that said sliver is kept under tension during the pneumatic conveying of said sliver through said injector.

23. A device for introducing a fiber sliver as set forth in claim 22, wherein said rollers are movable apart to receive said sliver.

24. A device for introducing a fiber sliver as set forth in claim 20, further comprising a sliver severing device for cutting said sliver to a predetermined length.

25. A device for introducing a fiber sliver as set forth in claim 20, wherein said mechanical feeding device and said injector are brought to said fiber processing machine for the introduction of said sliver to said sliver introduction funnel.

26. A device for introducing a fiber sliver as set forth in claim 25, wherein said mechanical feeding device and said injector are disposed on a traveling service unit.

27. A device for introducing a fiber sliver as set forth in claim 11, wherein said spinning machine is an open-end spinning machine for spinning yarn from sliver.

28. A device for introducing a fiber sliver as set forth in claim 11, wherein said device is configured on a travelling service unit, said travelling service unit configured for travelling along said processing machine.

29. A device for introducing a fiber sliver as set forth in claim 11, wherein said device is configured on a travelling can carriage unit.

30. A travelling automatic service unit configured to travel along a fiber processing machine to carry out various functions at spinning stations of the processing machine, said service unit further comprising:

a device for introducing a fiber sliver to said spinning stations which have an openable sliver feeding device and a sliver introduction funnel, said device further comprising (a) a sliver injector adapted to pneumatically introduce a sliver into said funnel;

(b) compressed air means disposed in said injector for directing a stream of compressed air into said funnel in a direction to convey said sliver into said feeding device; and (c) a control device configured to open said feeding device prior to directing said stream of compressed air into said funnel said control device being operably configured with said sliver injector.

31. The automatic service unit as in claim 30, wherein said sliver injector is disposed to contact said funnel and to form a pneumatic sliver feeding channel with said funnel, said compressed air means configured to direct said stream of compressed air into said pneumatic channel.

* * * * *